US005643006A

United States Patent [19]

Wang et al.

[11] Patent Number: 5,643,006

[45] Date of Patent: Jul. 1, 1997

[54] SAFE LIGHT BULB SOCKET STRUCTURE

[76] Inventors: Shou Jing Wang, 8-2, Pai Tea Fen, 1 Lind, Pai Tea Li; Sher Yea Tal, 2F, No. 2, Lane 86, Hsin Kang Street, both of Chupei City, Hsinchu Hsien, Taiwan

[21] Appl. No.: 577,004

[22] Filed: Dec. 26, 1995

[51] Int. Cl.[6] ..... H01R 4/24

[52] U.S. Cl. ..... 439/419; 439/280

[58] Field of Search ..... 439/273, 280, 439/419, 414, 272, 281, 282, 283, 274, 278

[56] References Cited

U.S. PATENT DOCUMENTS

| | | | |
|---|---|---|---|
| 745,173 | 11/1903 | Fielding | 439/273 |
| 3,660,801 | 5/1972 | Paulfus | 439/419 |
| 5,428,518 | 6/1995 | Huang | 439/280 |
| 5,474,467 | 12/1995 | Chen | 439/419 |

*Primary Examiner*—David Pirlot
*Assistant Examiner*—Tho Dac Ta
*Attorney, Agent, or Firm*—Morton J. Rosenberg; David I. Klein

[57] ABSTRACT

This invention relates to a safe light bulb socket structure mainly used for a C7 or C9 type light bulb. The socket shell of the socket structure according to the invention has an extended thin non-rigid sheet or an extended thin displaceable rib formed on its top and a thin annular appendage integrally molded on the opening at its lower end. When the socket shell is assembled with a light bulb and a socket cap, the thin sheet and the thin annular appendage will fill all leaks at the joining area, producing a watertight effect. In addition, two contact plates are arranged parallel to the electrical wire trench of the socket, with the upper ends thereof piercing into the plastic sheath of electrical wires and the lower ends thereof touching the tip and the ring contacts of the light bulb respectively. With this arrangement, the bad influence of contact plates on the joining of the socket shell and the light bulb, which is frequently found in a prior art socket structure, can be avoided.

1 Claim, 7 Drawing Sheets

SAFE LIGHT BULB SOCKET STRUCTURE

SUMMARY OF THE INVENTION

Decorative light bulb series are mostly used outdoors. For this reason safety and water-tightness of socket structure is an important consideration. For small light bulbs the problem is minor. However, for a larger light bulb such as a C7 or C9 type light bulb, the socket structure needs not only a waterproof effect but also good reliability in the joining of components. A socket structure of a prior art for larger light bulbs simply depends on good fitness among parts to achieve a watertight effect. As a result their waterproof performance is poor. Besides, a negative contact plate of the socket structure of a prior art extends to the sides of the light bulb to reach the negative contacts, resulting in difficulties in joining of the light bulb and the socket shell.

OBJECTS OF THE INVENTION

In view of the above-mentioned shortcomings, the primary object of the invention is to provide a safe light bulb socket structure that has a socket shell configured to have a deformable thin annular appendage and a thin sheet respectively formed on the top and the lower end thereof which can help enhancing the tightness of joining area when a socket cap and a light bulb are assembled on the socket shell.

Another object of the invention is to provide a safe light bulb socket structure that ensures a reliable joining of a light bulb and a socket shell by having two contact plates arranged parallel to the electrical wire trenches of the socket shell with the lower ends touching the tip and the ring contacts of the light bulb respectively.

BRIEF DESCRIPTION OF THE INVENTION

The features and advantages of this invention are explained in detail in the following description with reference to the accompanying drawings in which FIG. 1 shows a perspective representation of a light bulb safe socket structure of the invention;

Figure 1:
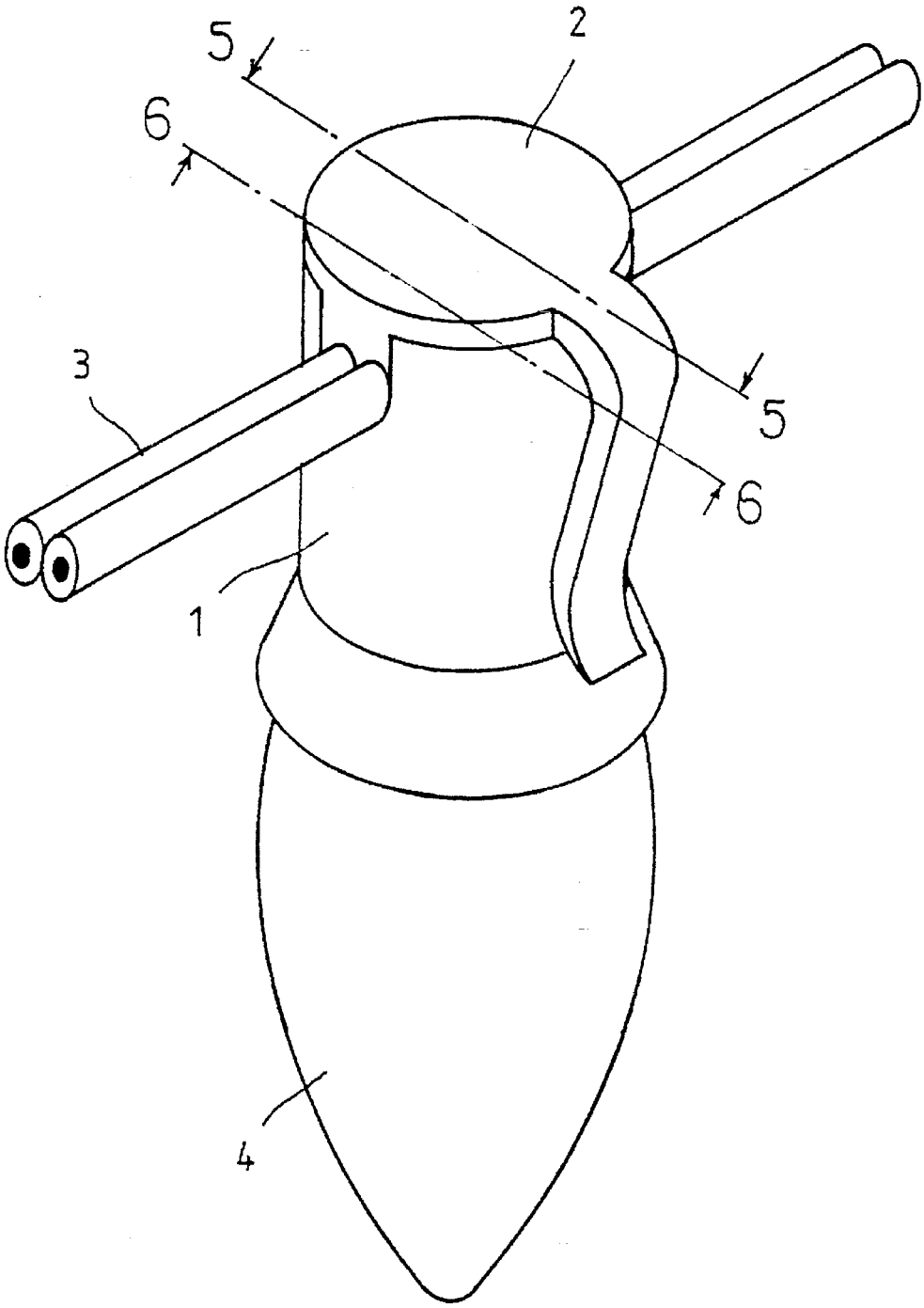
Figure 2:
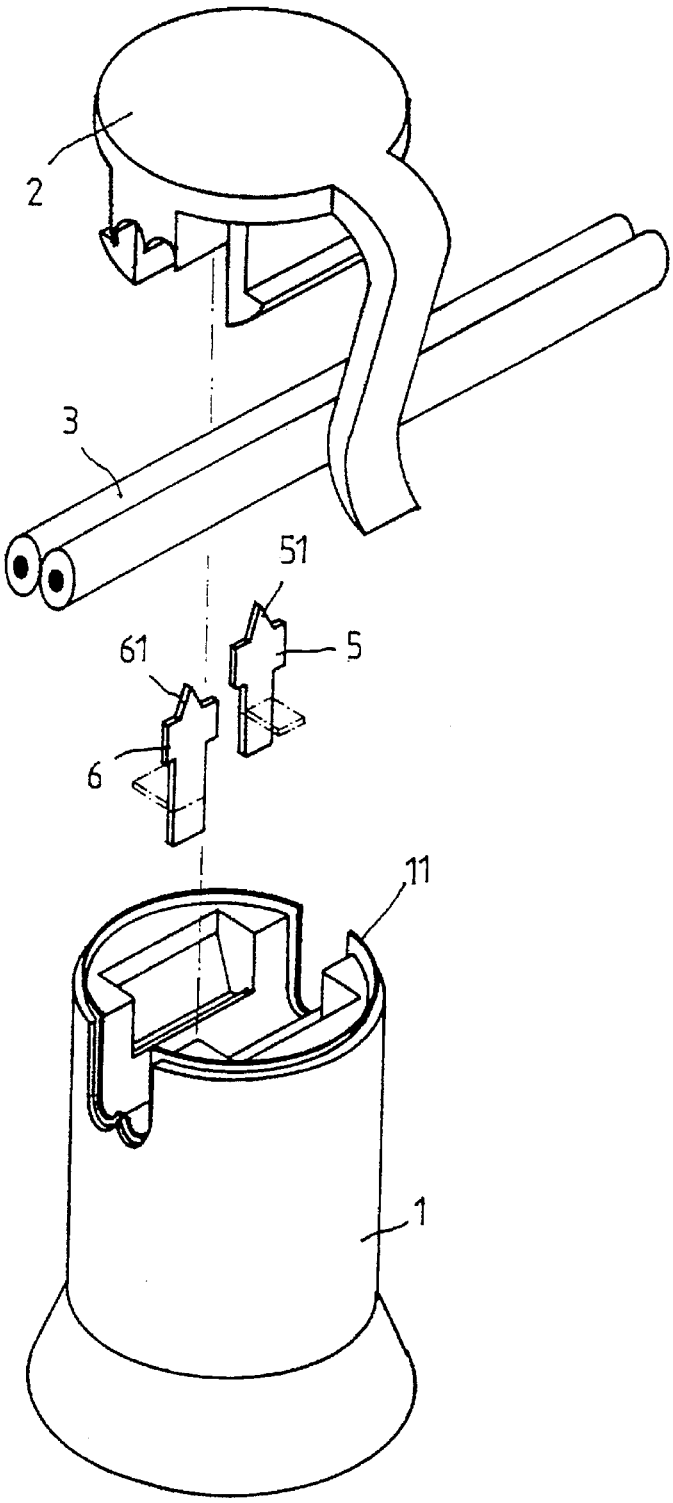
FIG. 2 is an exploded view of the light bulb safe socket structure shown in FIG. 1.
Figure 3:
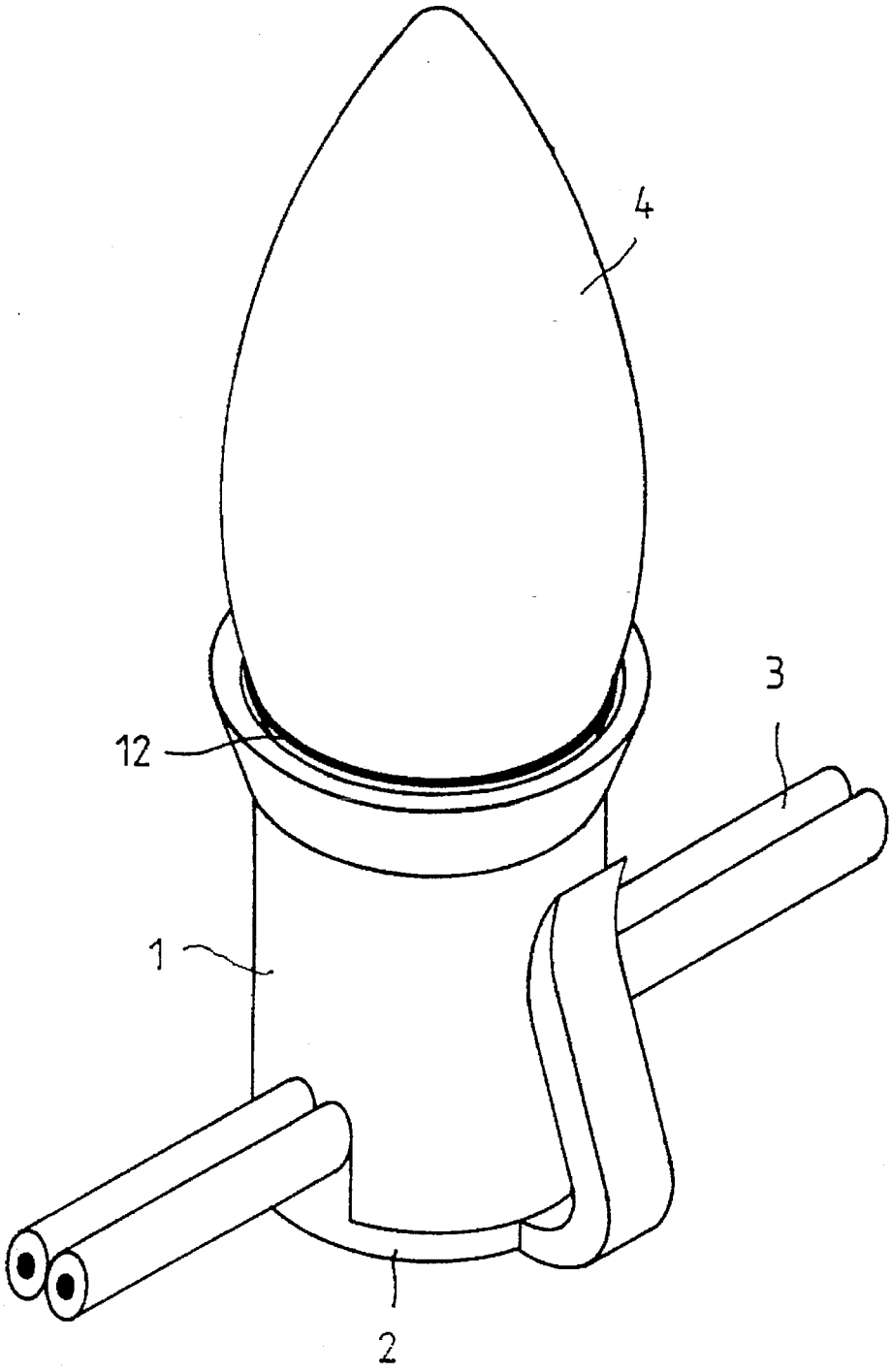
FIG. 3 shows in a upside-down manner a perspective representation of a light bulb safe socket structure of FIG. 1.
Figure 4:
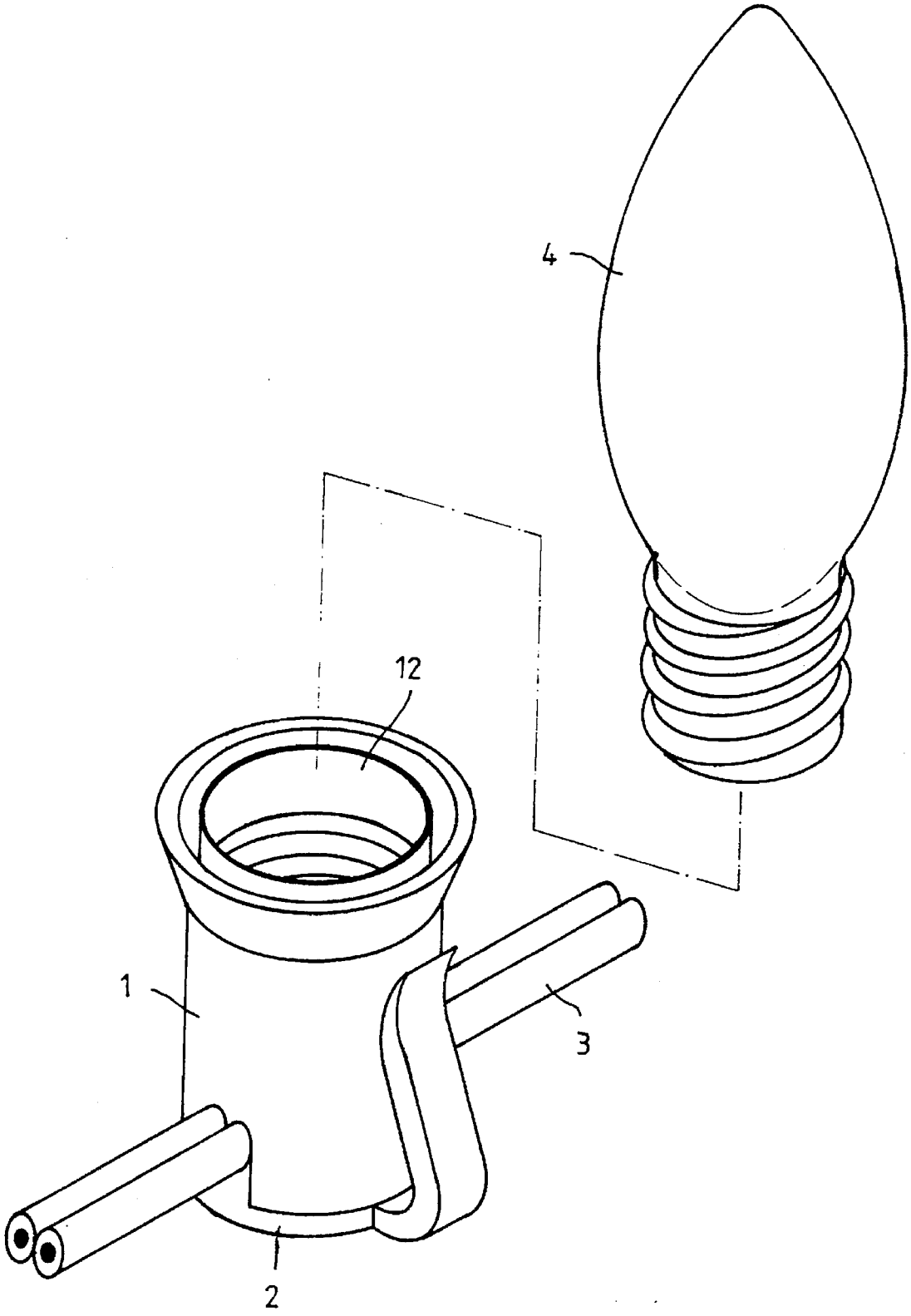
Figure 5:
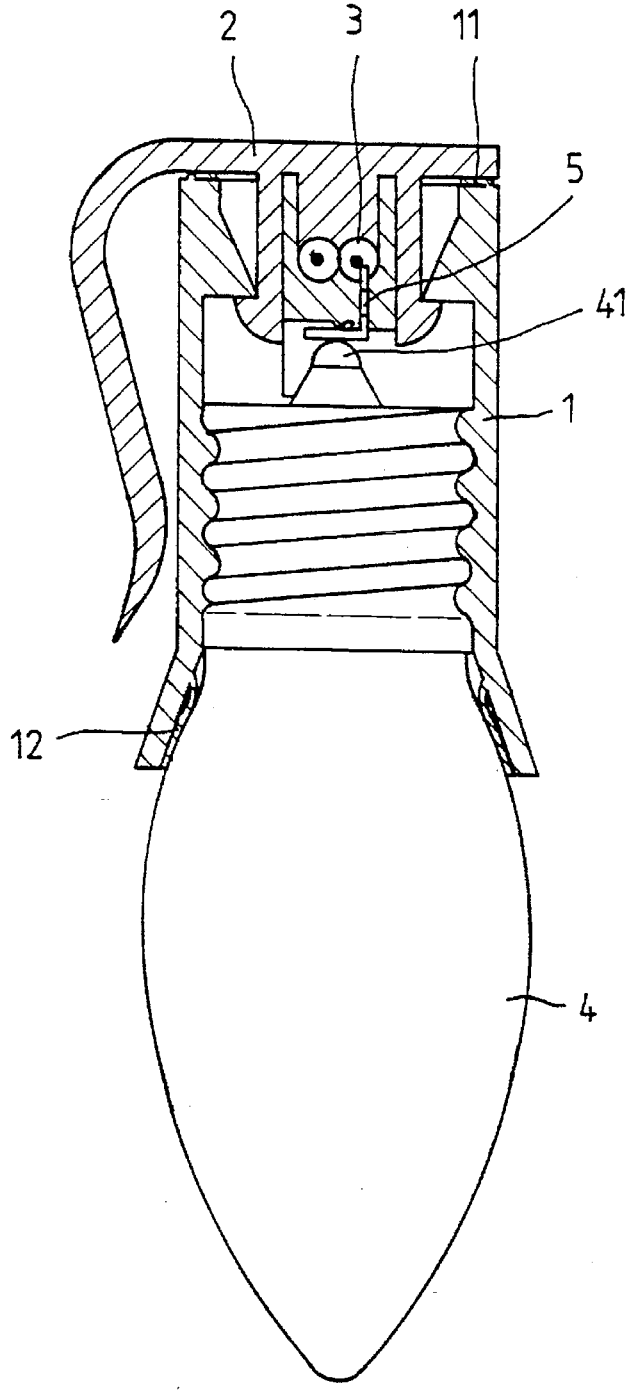
Figure 6:
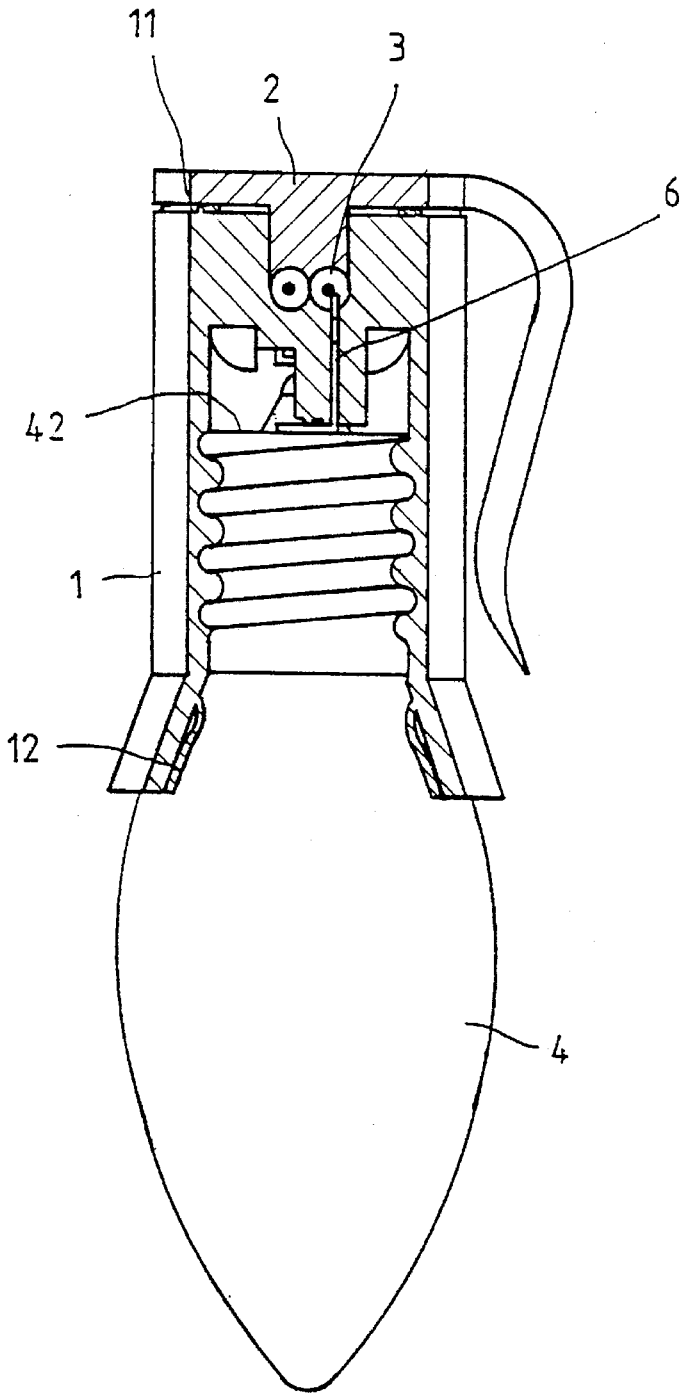
Figure 7:
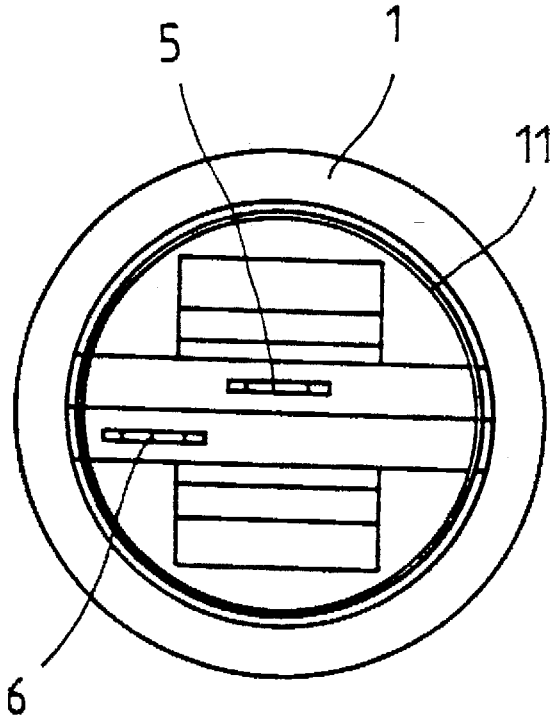

FIG. 4 separately shows in a perspective view the light bulb safe socket and the light bulb of FIG. 3;

FIG. 5 is a cross sectional view taken along the line 5—5 of FIG. 1;

FIG. 6 is a cross sectional view taken along the line 6—6 of FIG. 1; and FIG. 7 is a top view of the light bulb socket of the invention.

DETAILED DESCRIPTION OF A PREFERRED EMBODIMENT

Now a preferred embodiment of the present invention will be described in detail with reference to the accompanying drawings. The safe light bulb socket structure according to the invention comprises a socket shell (1), a socket cap (2), electrical wires (3) secured therein, and a light bulb (4) mounted on the socket shell (1). The primary improvements according to the invention consist in the socket shell (1) of which the top is configured to have a thin non-rigid sheet (11) and two slots disposed parallel to the electrical wire trenches for accommodating positive and negative contact plates (5), (6). Further, the socket cap (2) is similar to those used in a prior art socket structure and its functions are to secure electrical wires (3) in cooperation with the socket shell (1) in such a way that sharp tips (51), (61) of the contact plates (5), (6) pierce into the plastic sheath of electrical wires to touch metal conductor wires. With the arrangement of a thin non-rigid sheet or a thin displaceable rib (11), the socket structure of the invention can achieve a sealing and watertight effect by squeezing the thin sheet (11) as the socket cap (2) is assembled on the socket shell (1). The socket shell (1) according to the invention has a thin annular appendage (12) having a deformable property formed around the opening at its lower open end, which thin annular appendage is so designed that when a light bulb (4) is installed on the socket shell (1), the lower portion of the light bulb will force the thin annular appendage (12) to bend aside with a result that the thin annular appendix (12) abuts against the light bulb (4) to form a barrier not permitting the passage of moisture.

In addition, those two contact plates (5), (6) arranged parallel to the electrical wire trenches of the socket shell are bent at their lower portions with the result that the positive and the negative contact plate (5), (6) reach respectively the tip and the ring contacts (41), (42) of the light bulb (4) as shown in FIGS. 5 and 6. In the way the components complete an electrical circuit. Compared to the structure of a prior art in which the negative contact plate has to extend to side surfaces of the light bulb (4), that is, the contact plate must reside between the socket shell (1) and the light bulb (4), the socket structure of the invention can eliminate the interference of the contact plate with the engagement between the socket shell and the light bulb, enhancing joining strength.

What is claimed is:

1. A safe light bulb socket structure, comprising:

a socket shell having a cavity extending from a closed first end to an open second end thereof, said socket shell having a longitudinally extended substantially cylindrical wall extending between said first and second ends and encircling said cavity, said cylindrical wall having an internal surface with threads formed therein for coupling with a threaded base portion of a lamp, said first end of said socket shell having a wire receiving groove formed therein and extending transversely between a pair of opposing openings formed in said cylindrical wall, said first end having a pair of spaced parallel slotted openings extending between said wire receiving groove and said cavity, said first end of said socket shell being circumscribed by a thin displaceable rib integrally formed on an edge of said cylindrical wall at said second end and extending concentrically therefrom, said displaceable rib circumscribing a perimeter of said pair of opposing openings formed in said cylindrical wall, said internal surface of cylindrical wall having an integrally formed thin annular appendage extending therefrom disposed adjacent said second end of said socket shell for displaceably contacting a bulb portion of the lamp to define a watertight seal therebetween;

a pair of contacts respectively disposed in said pair of slotted openings, each of said pair of contacts having an insulation piercing end extending into said wire receiving groove and an opposing end angularly formed for conductive contact with a respective lamp terminal at a bottom end of the base portion of the lamp; and, a socket cap secured to said second end of said socket shell and forming a closure for said wire receiving groove, said socket cap pressing said displaceable rib to form a watertight seal therebetween.

* * * * *